US007405369B2

(12) United States Patent
Mukharzi et al.

(10) Patent No.: US 7,405,369 B2
(45) Date of Patent: Jul. 29, 2008

(54) INTERLOCK APPARATUS AND METHOD FOR DISCONNECT SWITCHES

(75) Inventors: Pothakamuri Mukharzi, Andhra Pradesh (IN); Pankaj Shrivastava, Andhra Pradesh (IN); Sundaresh Holla, Karnataka (IN)

(73) Assignee: General Electric Company, Schenectady, NY (US)

( * ) Notice: Subject to any disclaimer, the term of this patent is extended or adjusted under 35 U.S.C. 154(b) by 50 days.

(21) Appl. No.: 11/161,569

(22) Filed: Aug. 8, 2005

(65) Prior Publication Data

US 2007/0029178 A1 Feb. 8, 2007

(51) Int. Cl.
*H01H 9/22* (2006.01)
*H01H 33/00* (2006.01)

(52) U.S. Cl. ..... 200/50.03; 200/50.01

(58) Field of Classification Search ... 200/50.01–50.03, 200/50.12

See application file for complete search history.

(56) References Cited

U.S. PATENT DOCUMENTS 1,524,801 A * 2/1925 Schwennker ..... 200/50.03
1,901,036 A * 3/1933 Kinkead ..... 206/226
1,986,221 A * 1/1935 Sachs ..... 200/50.1
2,177,249 A * 10/1939 Hammerly ..... 200/50.01
3,760,132 A 9/1973 Ellsworth et al. ..... 200/50
4,104,491 A 8/1978 Duble ..... 200/50
4,118,607 A 10/1978 Shaffer ..... 200/50
4,305,610 A 12/1981 Piteo, Jr. et al. ..... 292/152
4,373,890 A 2/1983 Hehl ..... 425/153
4,806,710 A * 2/1989 Kalvaitis et al. ..... 200/50.12
4,862,125 A 8/1989 Maier et al. ..... 335/202
5,424,760 A 6/1995 Wirth et al. ..... 342/222
6,506,986 B2 1/2003 Bernier et al. ..... 200/50.01

* cited by examiner

*Primary Examiner*—Elvin Enad
*Assistant Examiner*—Lheiren Mae A Anglo
(74) *Attorney, Agent, or Firm*—Cantor Colburn LLP

(57) ABSTRACT

Switch apparatus is disclosed. The switch apparatus has an enclosure, having a openable cover, a switch disposed within the enclosure, a handle in operative communication with the switch, a spring in biasing communication with the handle, and interlocking members. The interlocking members, the handle, the biasing spring and the switch having positions relative to each other such that the interlocking members lock the cover in a closed position in response to the handle being biased toward an OFF position, and the switch contacts being closed. Further disclosed is a method for unlocking a closed cover of a switch apparatus. A spring biased handle is changed to an OFF biased position from an ON biased position passing through a non-biased position. Subsequent thereto, a switch being changed from a closed circuit to an open circuit position. Subsequent thereto, interlocking members are changed from an interlocked to a non-interlocked position.

16 Claims, 9 Drawing Sheets

INTERLOCK APPARATUS AND METHOD FOR DISCONNECT SWITCHES

BACKGROUND OF THE INVENTION

This invention relates to an interlocking device for preventing the opening of a cover for an enclosure for a switch or circuit breaker, and more specifically it pertains to an interlock for preventing the cover from being opened while the switch is in the ON or closed circuit position.

Switch apparatus of various types such as circuit breakers have been contained within enclosures in a manner well known in the art. The enclosures are normally provided with handles that are operatively connected to the enclosed switch for actuating the switch to the OFF or open circuit position when the cover is to be opened. It is common for these handles to include a latch interlock feature that prevents the cover of the enclosure from being opened when the handle is rotated to its fully ON position. In some instances, however, it may be desirable to lock the cover when the handle is not in its full ON position. Accordingly, there is a need for improvements in the art of switch enclosure interlocks.

BRIEF DESCRIPTION OF THE INVENTION

An embodiment of the invention includes an enclosure that has a base and a cover, the cover openably covering the base, at least one switch disposed within the enclosure, a handle in operative communication with the switch, a spring in biasing communication with the handle, and interlocking members, one of which being in operable communication with the handle, the other being fixedly attached to the cover. The interlocking members, the handle, the biasing spring and the switch having positions relative to each other such that the interlocking members lock the cover in a closed position in response to the handle being biased toward an OFF position, and the switch contacts being closed.

Another embodiment of the invention includes a method for unlocking a closed cover of a switch apparatus. A spring biased handle is changed to an OFF biased position from an ON biased position passing through a non-biased position. Subsequent thereto, a switch being changed from a closed circuit to an open circuit position. Subsequent thereto, interlocking members are changed from an interlocked to a non-interlocked position.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Embodiments will now be described, by way of example only, with reference to the accompanying drawings which are meant to be exemplary, not limiting, and wherein like elements are numbered alike in the Figures.

Figure 1:
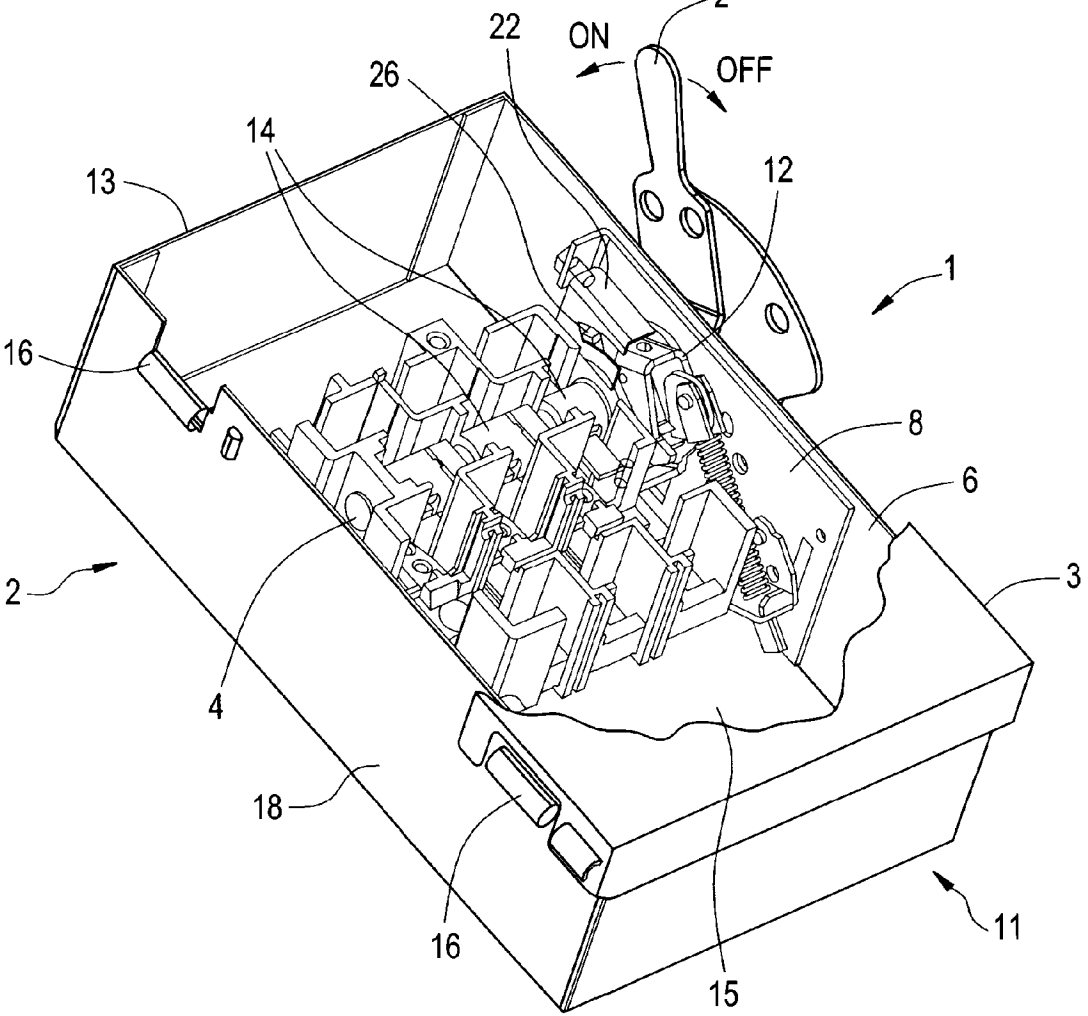
FIG. 1 is a perspective view of an exemplary embodiment of the switch apparatus of the present invention.

The perspective view in FIG. 1 is an embodiment of a switch apparatus 1 showing a partially cut away cover 3 over a base 13. The cover 3 and base 13 create an enclosure 11 that encloses a volume 15. A handle 2 is disposed external to the enclosure 11 is mounted to a shaft 4 that protrudes through a hole 7 in wall 6 and through a hole 9 in bracket 8. The handle 2 is fixedly attached to the shaft 4 such that rotational movement of the handle 2 causes the shaft 4 to rotate. A drive rotor 12, disposed internal to enclosure 11, is also fixedly attached to the shaft 4. At least one switch blade 14 is fixedly attached to the shaft 4 and is driven rotationally by the shaft 4 which is driven by the handle 2. Stated another way, the handle 2 is in operative communication with the switch blade 14. Therefore the handle 2, drive rotor 12, shaft 4 and switch blade 14 all pivot about an axis 5.

Rotation of the handle 2 in the direction of arrow ON rotates the shaft 4, which turns the drive rotor 12, and the switch blade 14, which closes a circuit. When the handle 2 is rotated in the direction of arrow OFF, the shaft 4 rotates the drive rotor 12 and the switch blade 14, which opens the circuit. Through the above configuration the handle 2 of the switch apparatus 1 is used to turn ON (close the switch) and turn OFF (open the switch) a circuit in which the switch apparatus 1 is electrically connected. The cover 3 is mounted to the base 13 by at least one hinge 16 located on wall 18 of the base 13. Since wall 18 is opposite wall 6 the cover 3 swings open from the side of the switch apparatus 1 where the handle 2 is located as shown by the arrow labeled open.

Figure 2:
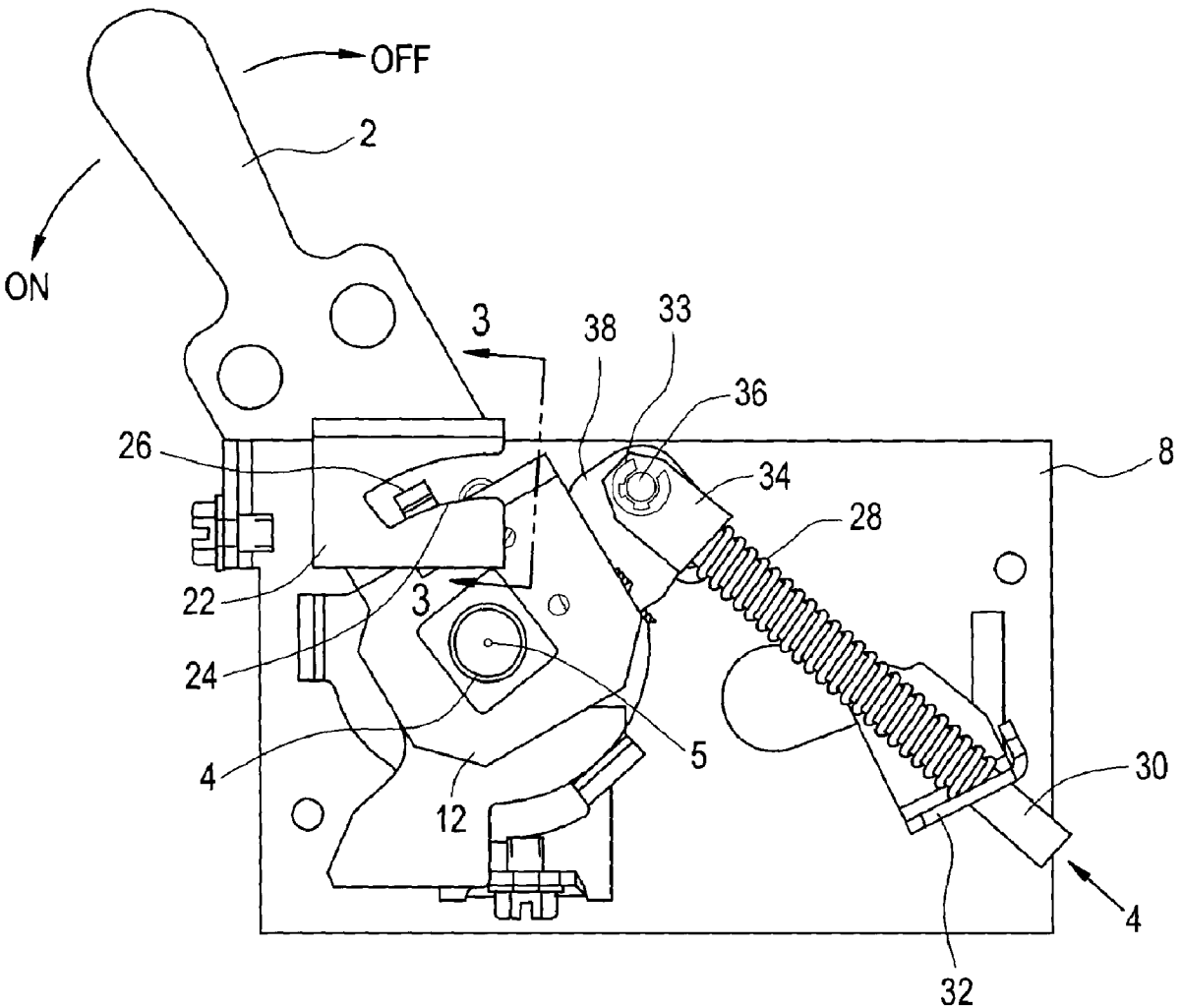
FIG. 2 is a partial side view of the inside of the enclosure of FIG. 1.
Figure 3:
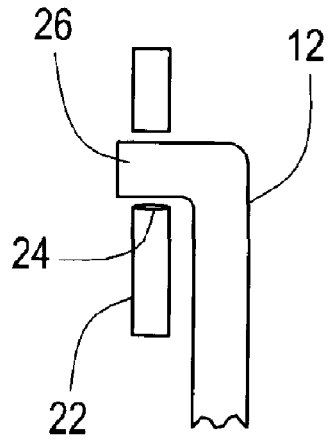
FIG. 3 is a partial side view taken along arrows 3-3 of FIG. 2.

Referring to FIGS. 2 and 3, a latching member 26 is integrally formed on a drive rotor 12 that is fixedly attached to the shaft 4 and thus pivots about axis 5. The latching member 26 travels in an arc shaped path concentric with the axis 5 as the handle 2 is rotated, as such, the latching member 26 is in operable communication with the handle 2. An arcuate surface 24 is formed on a receiver member 22 that is fixedly attached to the inside of the cover 3 near the handle 2. The partial cover 3 in FIG. 2 is shown in a closed position, which is defined as the cover position that locates the receiver member 22 relative to the base 13 such that the latching member 26 can interlock with the arcuate surface 24. The interlocking of the latching member 26 with the arcuate surface 24 establishing a locked condition for the cover 3.

The arcuate surface 24 is opened on the end toward the OFF position of the handle 2, such that the latching member 26 can travel beyond the arc length and out the open end of the arcuate surface 24 resulting in a non-interlocked condition of the latching member 26 to the arcuate surface 24. The latching member 26 being in a position beyond the arcuate surface 24 defining an unlocked position.

Figure 4:
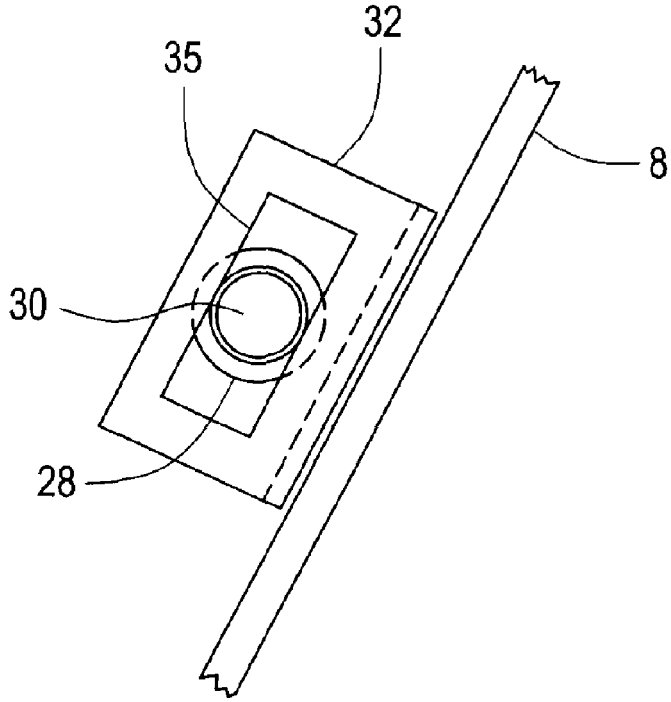
FIG. 4 is a partial end view of the spring guide of FIG. 2 taken along arrow 4.

A biasing spring 28 is incorporated to force the handle 2 toward either the ON or the OFF direction. The biasing spring 28 rides along a spring guide 30 and is compressed between a guide sleeve 32 and a fork 34 that is fixedly attached to the spring guide 30. A headed pin 36 is slidably engaged in through holes of both tines of the fork 34 and a rotor flange 38. The tines of the fork 34 are straddling the rotor flange 38 thereby pivotally fixing the fork 34 to the rotor flange 38 at headed pin 36. An E-clip 33 attached to the end of the headed pin 36 prevents the headed pin 36 from backing out of the through holes (holes not shown but located in area around headed pin 36) of the fork 34 and the rotor flange 38. Referring to FIG. 4, the guide sleeve 32, fixedly attached to the pivot bracket 8, has a slotted hole 31 that is large enough for the spring guide 32 to slide through the slotted hole 31 while creating a stop 35 for the end of the biasing spring 28 that is in contact with the guide sleeve 32.

The guide sleeve 32 and hole in the rotor flange 38 for the headed pin 36 are positioned relative to each other and to the handle 2 such that the length of the biasing spring 28 is longer in response to the handle 2 being at the handle's extremes positions of travel as compared to being at the handle's middle position of travel. Thus, the biasing spring 28 creates a rotational force to move the handle 2 toward either the ON or the OFF direction, therefore, the spring 28 is in biasing communication with the handle 2. The handle position creating the shortest biasing spring 28 is called TDC for top-dead-center. At TDC there is no rotational force from the biasing spring 28 acting on the handle 2. Very close in either direction from TDC the frictional forces are greater than the rotational force from the biasing spring 28 and the handle 2 if released will not move. This area is called the friction circle. The handle 2 must be moved beyond the frictional circle in order for it to move freely based on the force of the biasing spring 28 only. The handle position of the TDC point can be set anywhere within the full range of the movement of the handle 2 by the locations of the guide sleeve 30 and the hole in the rotor flange 38 relative to the handle 2 and the axis 5.

Figure 5:
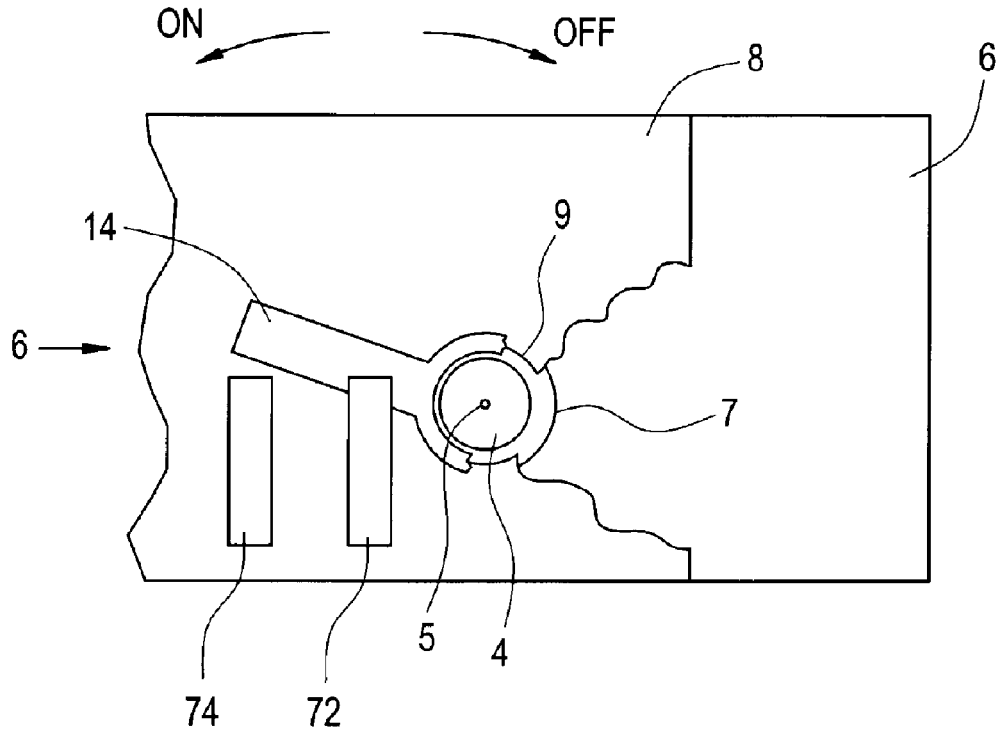
FIG. 5 is a side view of an embodiment of a switch assembly for use in accordance with an embodiment of the invention.
Figure 6:
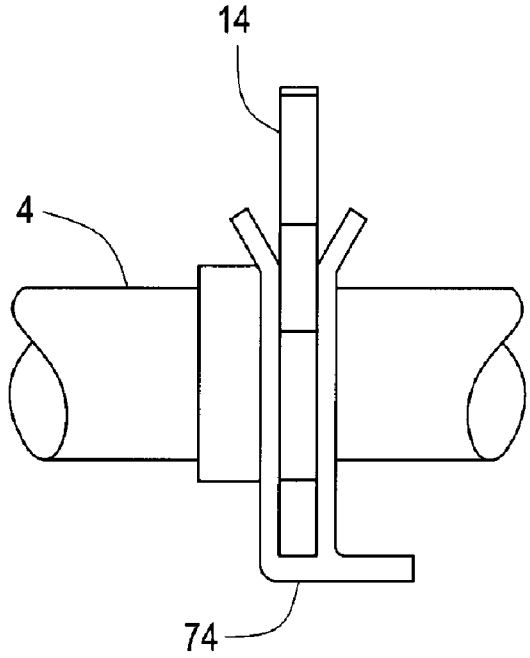
FIG. 6 is a front view of the switch assembly of FIG. 5.

Referring to FIGS. 5 and 6, a switch blade 14 is fixedly attached to shaft 4 and both rotate about axis 5. The rotation of the switch blade 14 toward the ON from the OFF direction first brings switch blade 14 into contact with a line contact 72 and then with a load contact 74. The switch blade 14 being in contact with both the line contact 72 and the load contact 74 defines a closed circuit or ON condition. An open circuit, or OFF condition exists if the switch blade 14 is not in contact with both the line contact 72 and the load contact 74 simultaneously.

Figure 7:
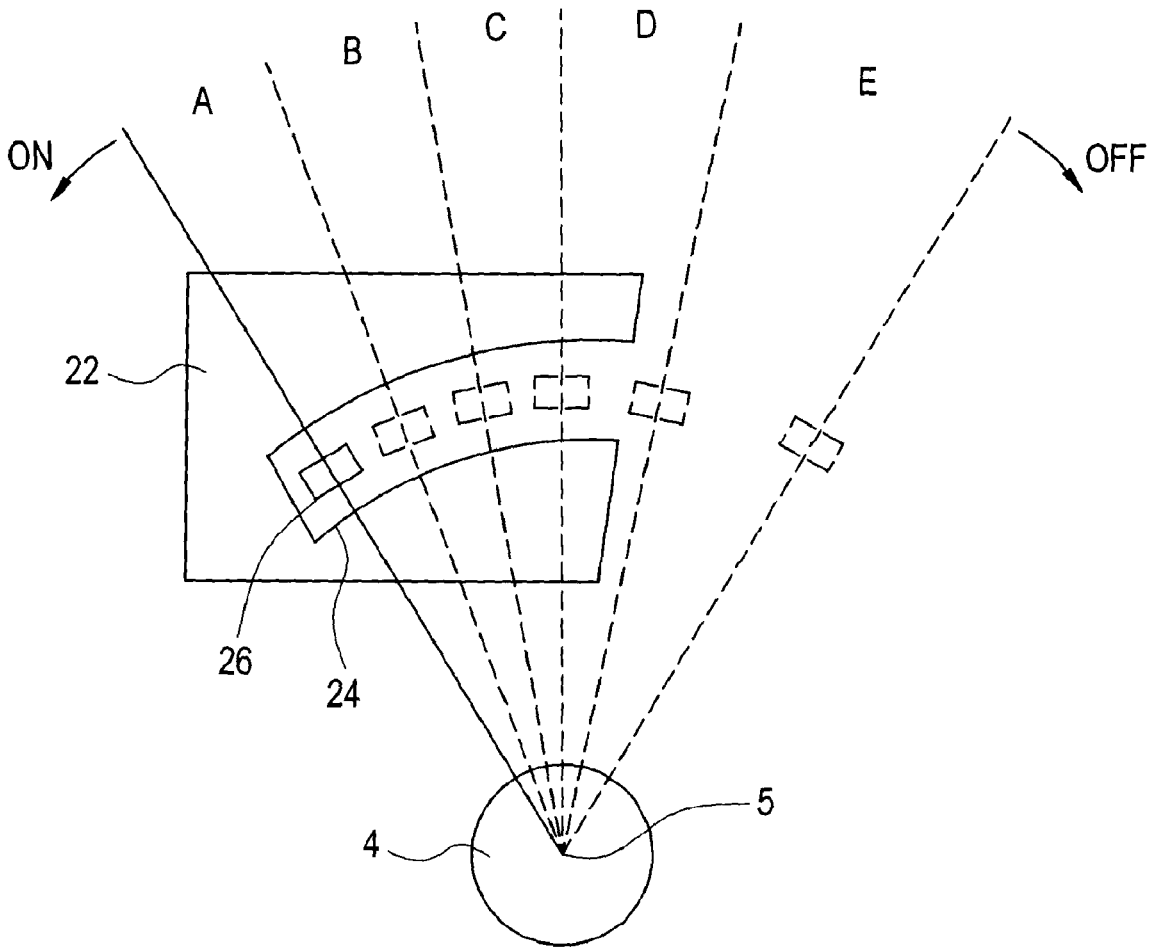
FIG. 7 shows five zones created from six possible handle positions for use in accordance with an embodiment of the invention.

Referring to FIG. 7, five zones are defined by the relationships of; the cover being locked or not, the switch being ON or OFF and the handle 2 being biased in the ON, OFF or no direction. The five zones; A, B, C, D and E exist between the limits of the movement of the handle 2, with A being the furthest in the ON direction, and E being the furthest in the OFF direction. Zone A being defined by the following conditions; the cover 2 is locked, the switch is ON and the handle 2 is biased in the ON direction. Zone B being defined by the following conditions; the cover 2 is locked, the switch is ON and the handle 2 is in the friction circle (not biased). Zone C being defined by the following conditions; the cover 2 is locked, the switch is ON and the handle 2 is biased in the OFF direction. Zone D being defined by the following conditions; the cover 2 is locked, the switch is OFF and the handle 2 is biased in the OFF direction. Zone E being defined by the following conditions; the cover 2 is unlocked, the switch is OFF and the handle 2 is biased in the OFF direction. Zone C is of particular interest since it shows that the handle can be biased toward OFF while the cover is locked and the switch is in the ON position.

Figure 8:
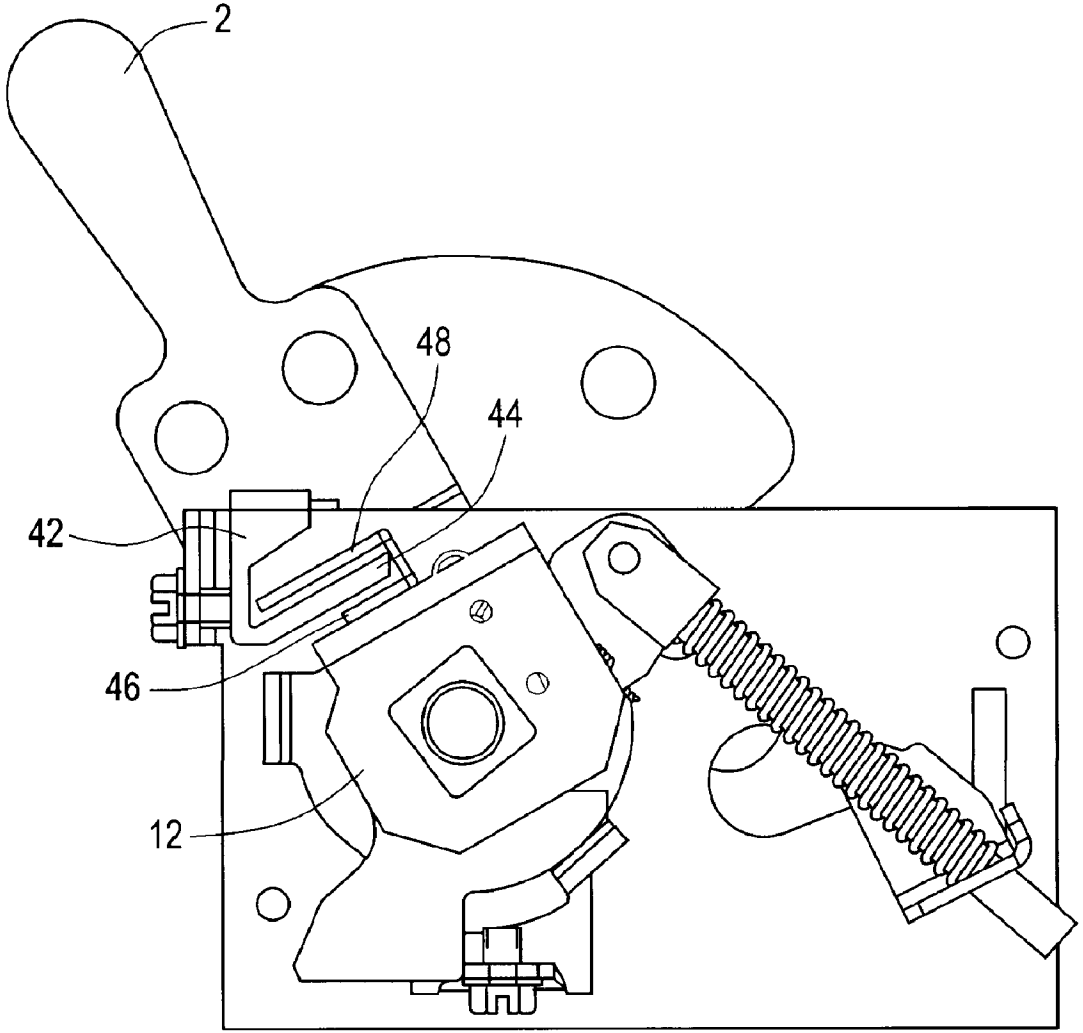
FIG. 8 is a partial side view similar to that of FIG. 2 of another embodiment of the invention.

Referring now to FIG. 8, an alternate embodiment of the invention is shown. In this embodiment a latching member 48 is formed on a latching plate 46 that is fixedly attached to the drive rotor 12. And, a receiver finger 44 is formed on a receiver member 42 that is fixedly attached to the cover 3. The latching member 48 of the latching plate 46 rotates with the drive rotor 12 and the handle 2 to interlock with a receiver finger 44 of the receiver member 42. The latching member 48 is axially aligned with the receiver finger 44 such that the interlocking of the latching member 48 with the receiver finger 44 lock cover 3 in a closed position. The lengths of the latching member 48 and the receiver finger 44 can be set to interlock with each other at any position of the handle 2 to lock the cover 3 closed.

Figure 9:
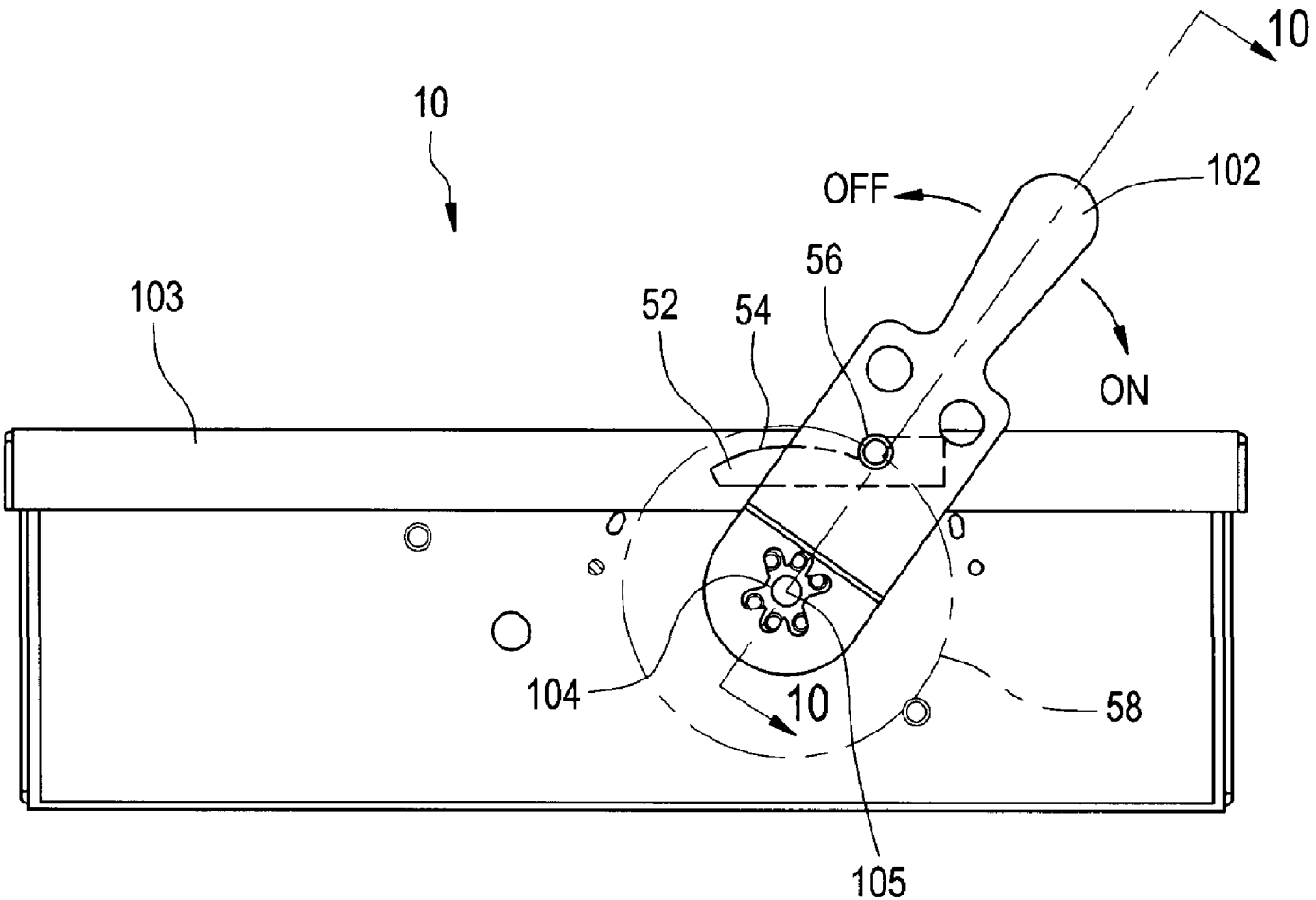
FIG. 9 is an external side view of another embodiment of the invention.

The interlocking members of the embodiments shown in FIGS. 1 and 8, are disposed within the enclosure 11, preventing defeat of the interlocks while the cover 3 is closed. In an alternate embodiment, and referring now to FIG. 9, interlocking members are disposed outside the enclosure of switch apparatus 10 and can therefore be defeated (as will be described below) while the cover 103 is closed.

Figure 11:
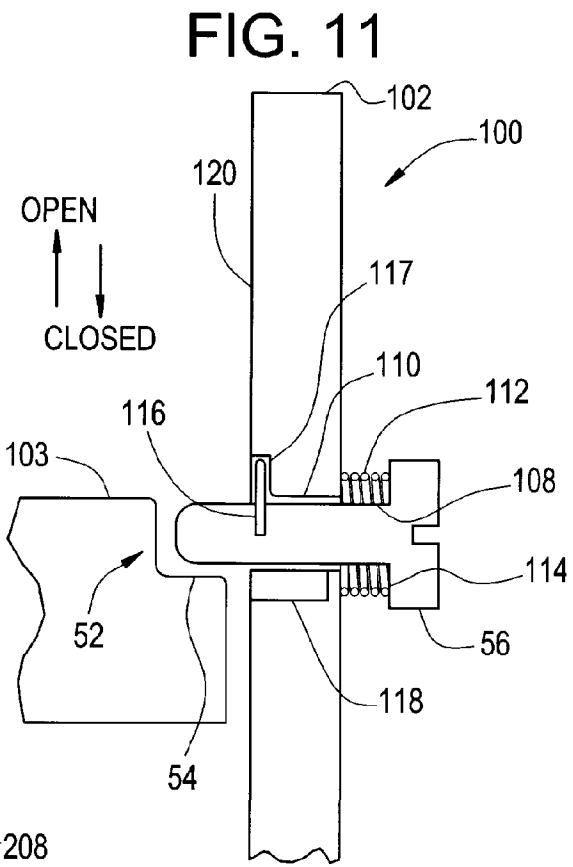
FIG. 11 is another cross sectional view of FIG. 9 taken along arrows 10-10 showing an alternate positional configuration from that of FIG. 10.
Figure 10:
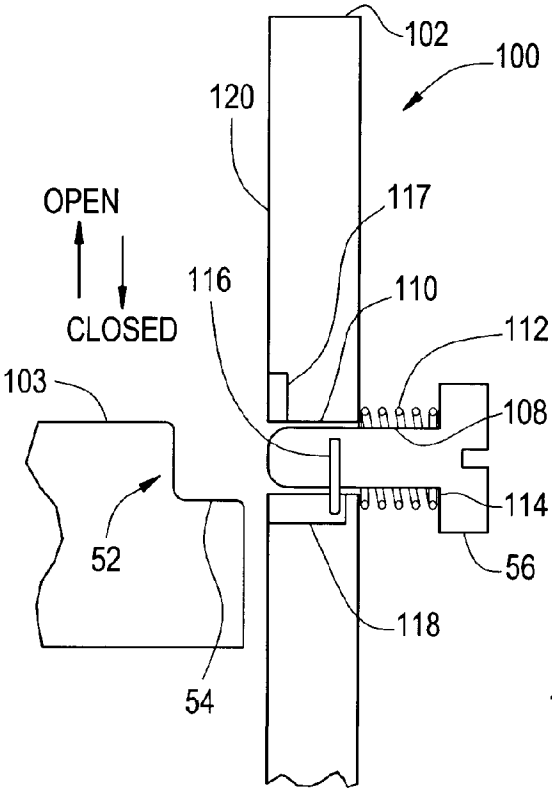
FIG. 10 is a cross sectional view of FIG. 9 taken along arrows 10-10.

A latching member 56 is movably attached to a handle 102 and travels in a radial arc 58 concentric with an axis 105 of shaft 104 when the handle 102 is rotated. A receiver member 52 is fixedly attached to the cover 103 and has an arcuate surface 54 that is concentric with the shaft 104 in response to the cover 103 being closed. The radial arc 58 is larger than the radius of the arcuate surface 54 to create a small clearance gap between the latching member 56 and the arcuate surface 54. Referring to FIGS. 10 and 11, the latching member 56 protrudes from the handle 102 in a direction towards the cover 103 to interlock with the arcuate surface 54 of the receiver member 52. Thus the latching member 56 and the receiver member 52 act as an interlock to lock the cover 103 in the closed position.

Referring back to FIG. 9, the latching member 56 can travel in an arc length that is longer than the arc length of the arcuate surface 54. This additional travel is in the direction of arrow OFF, such that the latching member 56 can travel beyond the arc length of the arcuate surface 54 in response to the handle 102 being rotated sufficiently far in the direction of the arrow OFF, as such, a non-interlocked condition of the latching member 56 with the receiver member 52 results, thereby allowing the cover 103 to be opened.

Referring back to FIGS. 10 and 11, the latching member 56 is movably attached to the handle 102. FIG. 11 shows the latching member 56 in interlocked position with arcuate member 54, and FIG. 10 shows the latching member 56 not interlocked with arcuate member 54, thus creating a defeatable interlocking cover 103. This embodiment incorporates a handle 102 with a spring loaded pin 100 as the latching member 56.

A shaft 108 of the latching member 56 is slidably engaged in a hole 110 through the handle 102. A spring 112 positioned around the shaft 108 is in compression between the handle 102 and a head 114 of the latching member 56 forcing the head 114 of the latching member 56 in a direction away from the handle 102. A pin 116 fixedly attached to the shaft 108 protrudes a radial distance greater than the radius of the hole 110 preventing the shaft 108 from withdrawing from the hole 110 in the handle 102. Two slots 117/118 cut into a surface 120 of the handle 102 are positioned 180 degrees from each other around the perimeter of the hole 110. The slots create cavities in the surface 120 of the handle 102 that the pin 116 is forced into by the spring 112, thereby, preventing the latching member 56 from rotating relative to the handle 102. To move the pin 116, for example, from slot 117 to slot 118, the spring 112 must be compressed while the latching member 56 is rotated through 180 degrees.

The slots 117/118 are cut to different depths from the surface 120 to create two levels of protrusion of the latching member 56 from the surface 120. The depth of slot 117 is shallow to hold the latching member extended over the arcuate surface 54 to lock the cover 103 closed, whereas the depth of slot 118 is deep to position the latching member 56 with no protrusion from surface 120 thereby preventing locking of the cover 103. This embodiment, therefore, permits the interlocking of the cover 103 to be defeated.

Figure 12:
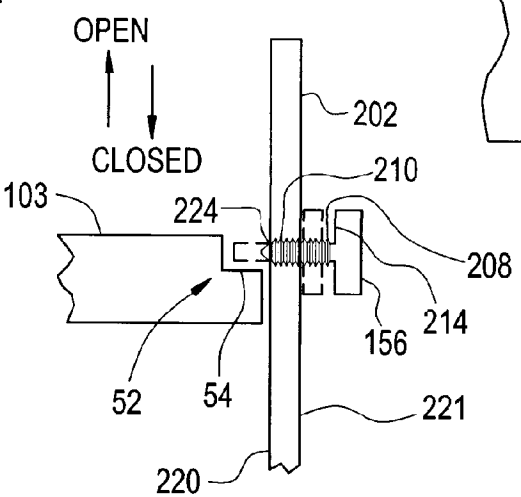
FIG. 12 is another cross sectional view of FIG. 9 taken along arrows 10-10 showing another exemplary embodiment.

FIG. 12 shows another embodiment of a defeatable interlocking cover. As in the previous embodiment, a latching member 156 is movably attached to the handle 202. The latching member 156 is a screw and has a threaded shaft 208 that screws into a threaded hole 210 through the handle 202. By screwing the latching member 156 in until a screw head surface 214 is in contact with a handle surface 221, the shaft 208 will protrude from a handle surface 220 sufficiently to interlock with the arcuate member 54 to lock the cover 103 closed. By screwing the latching member 156 out until an upset 224 on the last thread of shaft 208 binds with hole 210, the shaft will not protrude from the surface 220 of the handle 102, and will therefore not interlock with the arcuate member 54. This embodiment, therefore, permits the interlocking of the cover 103 to be defeated.

Figure 13:
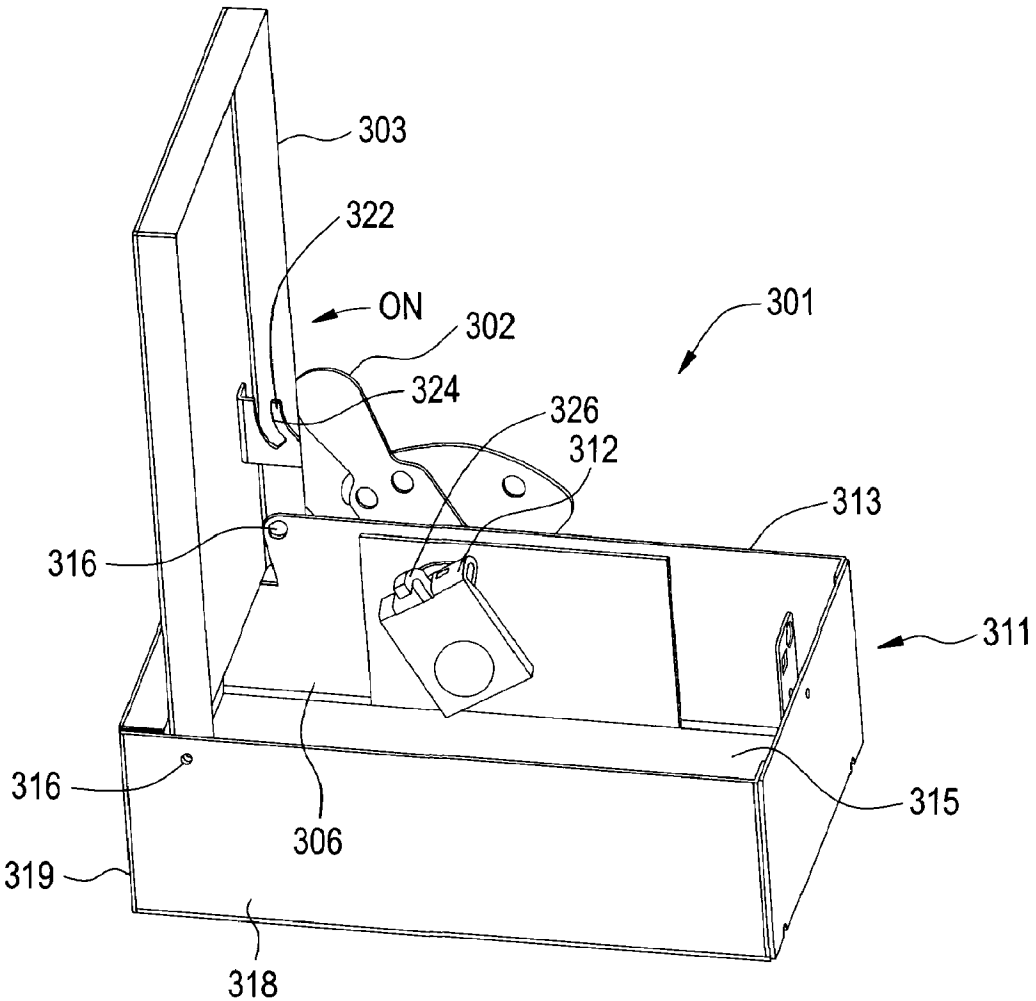
FIG. 13 is a perspective view of an exemplary embodiment of the switch apparatus of the present invention with an alternate cover.

The perspective view in FIG. 13 is an embodiment of a switch apparatus 301 showing a cover 303 opened over a base 313. The cover 303 and the base 313 create an enclosure 311 that encloses a volume 315. The cover 303 is mounted to the base 313 by hinges 316 located on walls 318 and 306 of the base 313. A drive rotor 312 being in operative communication with the handle 302 rotates as handle 302 rotates. The latching member 326, being formed of drive rotor 312, rotates in response to the handle 302 being rotated. The latching member 326 engages with arcuate surface 324 of receiving member 322 attached to the cover 303 to lock the cover 303 closed in response to the handle 302 being rotated toward arrow ON while the cover 302 is closed over the base 313. It should be understood that other embodiments may have the cover 303 pivot about hinges located on wall 319 without deviating from the scope of the present invention.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A switch apparatus comprising:

an enclosure; having a base and a cover, the cover openably covering the base;

at least one switch disposed within the enclosure;

a handle in operative communication with the switch;

a spring in biasing communication with the handle; and interlocking members, one of which being in operable communication with the handle, the other being fixedly attached to the cover, wherein:

the interlocking members, the handle, the biasing spring and the switch having positions relative to each other such that;

the interlocking members lock the cover in a closed position in response to the handle being biased toward an OFF position, and switch contacts being closed; and the interlocking members lock the cover in a closed position in response to the handle being biased toward an OFF position, and the switch contacts being opened.

2. The switch apparatus of claim 1 wherein:

the interlocking members, the handle, the biasing spring and the switch having positions relative to each other such that;

the interlocking members lock the cover in a closed position in response to the handle being biased toward an ON position, and the switch contacts being closed.

3. The switch apparatus of claim 1 wherein:

the interlocking members, the handle, the biasing spring and the switch having positions relative to each other such that;

the interlocking members lock the cover in a closed position in response to the handle having NO bias, and the switch contacts being closed.

4. The switch apparatus of claim 1 wherein:

the interlocking members, the handle, the biasing spring and the switch having positions relative to each other such that;

the interlocking members being in an unlocked cover position in response to the handle being biased toward an OFF position, and the switch contacts being opened.

5. The switch apparatus of claim 1 wherein:

the handle pivots about an axis.

6. The switch apparatus of claim 1 wherein:

the interlocking members are disposed within the enclosure.

7. The switch apparatus of claim 1 wherein:

the interlocking members are disposed external to the enclosure, and the receiving member receives the latching member to establish a locked cover condition.

8. The switch apparatus of claim 7 wherein:

the latching member is movably attached to the handle, wherein:

a first position of the latching member being interlockable with the receiving member, and a second position of the latching member not being interlockable with the receiving member.

9. The switch apparatus of claim 8 wherein:

the latching member is a screw.

10. The switch apparatus of claim 8 wherein:

the latching member is a spring loaded pin.

11. The switch apparatus of claim 1, wherein:

the switch is responsive to rotational movement of the handle to change state of the switch contacts.

12. A method of unlocking a closed cover of a switch apparatus, the method comprising:

changing a spring biased handle to a first OFF biased position from an ON biased position passing through a non-biased position, while maintaining interlocking members in an interlocked position;

in response to the changing the spring biased handle to the first OFF biased position, changing a switch from a closed circuit to an open circuit position, while maintaining the interlocking members in the interlocked position;

subsequent to the changing the switch to the open circuit position, changing the spring biased handle to a second OFF biased position from the first OFF biased position; and in response to the changing the spring biased handle to the second OFF biased position, changing interlocking members from the interlocked position to a non-interlocked position.

13. The method of claim 12 further comprising:

rotating the handle in operable communication with;

the biasing spring, the switch, and the latching member.

14. A switch apparatus comprising:

an enclosure; having a base and a cover, the cover openably covering the base;

at least one switch disposed within the enclosure;

a handle in operative communication with the switch;

a spring in biasing communication with the handle; and interlocking members, one of which being in operable communication with the handle, the other being fixedly attached to the cover, wherein:

the interlocking members, the handle, the biasing spring and the switch having positions relative to each other such that;

the interlocking members lock the cover in a closed position in response to the handle being disposed in a first OFF biased position, and switch contacts being closed; and the interlocking members lock the cover in a closed position in response to the handle being disposed in a second OFF biased position, and the switch contacts being opened.

15. The switch apparatus of claim 14 wherein:

the interlocking members, the handle, the biasing spring and the switch have positions relative to each other such that;

the interlocking members allow the cover to be opened in response to the handle being disposed in a third OFF biased position, and the switch contacts being opened.

16. The switch apparatus of claim 14, wherein:

the switch is responsive to rotational movement of the handle to change state of the switch contacts.

* * * * *